US005868092A

United States Patent [19]

Milidragovic

[11] Patent Number: 5,868,092

[45] Date of Patent: Feb. 9, 1999

[54] WING SAIL AND METHOD OF USE

[76] Inventor: Mladen Milidragovic, 610-1220 Cardero St., Vancouver, BC, Canada, V6G 2H7

[21] Appl. No.: 881,677

[22] Filed: Jun. 24, 1997

[51] Int. Cl.[6] ..... B63H 9/08

[52] U.S. Cl. ..... 114/102; 114/39.001

[58] Field of Search ..... 114/39.1, 102, 114/103, 89, 90

[56] References Cited

U.S. PATENT DOCUMENTS

| | | | |
|---|---|---|---|
| 4,341,176 | 7/1982 | Orrison | 114/102 |
| 4,945,847 | 8/1990 | Walker | 114/102 |
| 5,320,310 | 6/1994 | Mitchell | 114/103 |

OTHER PUBLICATIONS

"Curious Yachting Inventions" by Joachim Schult (ISBN 0–808–2104–1) Various Figs. of this book as indicated on the attached sheet.

*Primary Examiner*—Ed L. Swinehart
*Attorney, Agent, or Firm*—Ted Masters

[57] ABSTRACT

A sail (20) for a sailing vessel (500) includes a leading spar (22), a coplanar trailing spar (24), and a movable spar (28) disposed between the two. A sheath (30) of sail cloth traversely surrounds the three spars forming a flexible double-sided wing-like structure. When the wind (600) blows against sail (20), movable spar (28) is urged toward the leeward side of sail (20), and transforms that side into the curved or long side of an airfoil, thereby creating a push force (54) which propels the sailing vessel (500).

23 Claims, 5 Drawing Sheets

Fig. 4
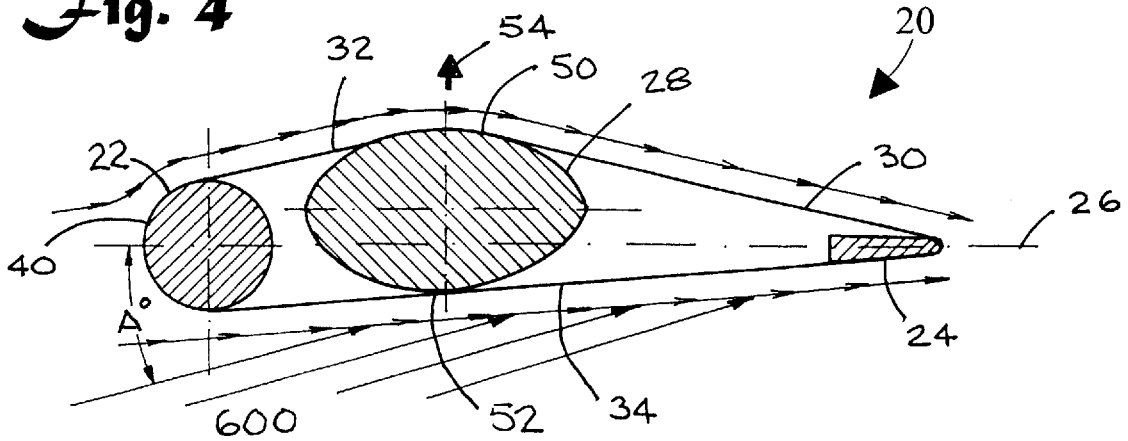
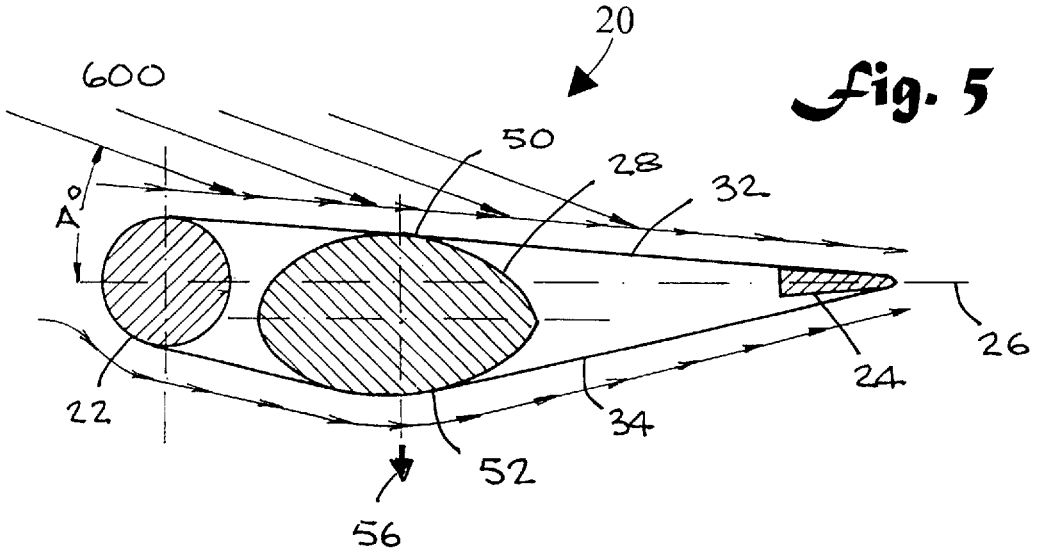
Fig. 5
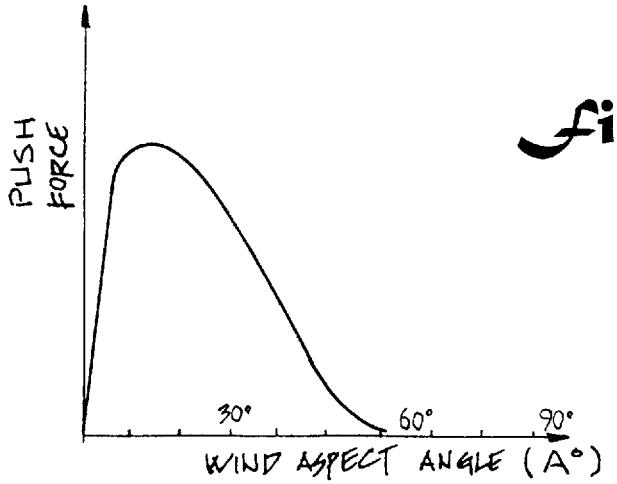
Fig. 6

WING SAIL AND METHOD OF USE

TECHNICAL FIELD

The present invention pertains to sails for sailing vessels such as ships, boats, yachts, sail boards and the like, and more particularly to a sail which has the shape of an airfoil.

BACKGROUND ART

The sailing art is replete with both conventional and unconventional sail designs. Certain of these devices are shaped like the wing of an airplane. For example, "Curious Yachting Inventions" by Joachim Schult (ISBN 0-808-2104-1) discloses several wing-shaped sail designs. FIGS. 56 and 57 show a sail which is inflatable in order to give it an airfoil shape. FIG. 73 depicts the Dyna-Ship which has rigid airfoils instead of cloth sails, and these are operated by remote control from the bridge. They are set on hollow, one-piece masts of variable elliptical sections. The airfoils are roughly trapezoidal in shape, and similar to the paddles on a turbine wheel, are set at decreasing angles to the wind looking forward. FIG. 74 describes a trimaran whose five vertical airfoils can be folded down when the boat is in harbour. The 28 ft long prototype goes as close as 6° to the apparent wind, as opposed to 20° for boats with cloth sails. In spite of its sail area of 323 sq.ft, which is large in relation to the hull weight, the vessel cannot capsize, because the wind flow always meets the sails at the optimum angle. The whole set of airfoils is always angled to the wind in such a way that they produce the maximum drive with the minimum resistance. FIG. 75 comprises an adjustable profiled airfoil to which a cloth sail is attached. can determine the most favourable profile which would give the least resistance with the maximum or drive. FIG. 77 consists of an improved airfoil design which allows the curvature of the sail to be selectively changed. FIG. 83 shows a propulsion system in which several airfoils rotating around a common axis are mounted on a revolving disc. FIGS. 86 and 87 depict a pivoting airfoil which also moves fore and aft and athwartships. The design reduces flow-pressure on the rotation axis and facilitates the trimming of the airfoil sail. FIG. 88 includes a multi-airfoil sail in which it is possible, with the help of parallel struts, to move the two outer airfoils forward or backward in relation to the central one without noticeably changing the angle of incidence. FIG. 89 consists of airfoils which freely pivot around a vertical axis. A vane is set to port or starboard and thus creates negative pressure on the convex side of the sail, which sets itself at an angle to the wind and consequently produces drive. "Windship Technology—Proceedings of the International Symposium on Windship Technology (Windtech '85)", Southampton, U.K., Apr. 24–25, 1985 edited by C. J.Satchwell, ISBN 0444425330 (set), LCCN 85016170//r88, discloses numerous wing sails, mostly of rigid construction for larger ships.

DISCLOSURE OF INVENTION

The present invention is directed to a wing-shaped sail for sailing vessels which has the form of an airfoil, thereby providing a push force similar to the lift force of an airplane wing. Through the use of a movable spar, the present invention has the unique property of being able to assume an airfoil shape on either of its two sides. That is, depending upon the direction of the wind relative to the sail, the moveable spar is urged by the wind toward the leeward side of the sail, thereby transforming the leeward side into the long side of an airfoil. The airfoil shape results in a pushing force which is utilized to propel the sailing vessel.

Moreover, by making a small change in the angle of attack with the wind, the leeward side changes, the airfoil shape is reversed, and the direction of the pushing force is rapidly and dramatically altered.

The present invention enjoys many advantages over conventional sails. The present invention allows sailing much "closer to the wind" with very small angles of attack, thereby substantially reducing resistance. Maximum pushing force is developed in the approximate 10° to 20° angle of attack range. Furthermore, the height of the present sail can be only 30–40% of that of a conventional sail. Because the sail of the present invention is shorter, the tilting moment created by the wind is less. This allows both a reduction in ballast, and a streamlined hull design resulting in greater vessel speed. Also, due to the shorter sail the push force of the sail is directed horizontally. This is in contrast to a conventional sailing vessel which heels over and therefore dissipates some of the sailing force vertically.

In accordance with a preferred embodiment of the invention, a leading spar is connected to a substantially coplanar trailing spar thereby defining a sail plane. A movable spar is disposed between the leading spar and the trailing spar. The movable spar is substantially parallel to the sail plane. The leading spar, the movable spar, and the trailing spar are traversely surrounded by a sheath of sail cloth. The movable spar is moveable in a direction substantially perpendicular to the sail plane.

In accordance with an important aspect of the invention, the leading spar, the trailing spar, and the movable spar are substantially parallel, and the leading spar is spaced a predetermined distance from the trailing spar.

In accordance with an important feature of the invention, at least one traverse rib connects the leading spar and the trailing spar, the traverse rib is substantially perpendicular to the leading spar.

In accordance with another important aspect of the invention, the traverse rib is longitudinally adjustable so that the predetermined distance may be selectively changed.

In accordance with another important feature of the invention, the leading spar has a first length, the trailing spar has a second length, the movable spar has a third length, and the sheath has a fourth length, wherein the first length is greater than the second length, and the second length is greater than the third length, and the third length is substantially equal to the fourth length.

In accordance with another aspect of the invention, the leading spar has a curved leading edge which abuts the sheath.

In accordance with another feature of the invention, the leading spar has a substantially circular cross section.

In accordance with another aspect of the invention, the trailing spar has a substantially V-shaped trailing edge which abuts the sheath.

In accordance with another feature of the invention, the movable spar is located nearer to the leading spar than to the trailing spar.

In accordance with an aspect of the invention, the leading spar has a longitudinal axis. A rotary means is connected to the leading spar so that the leading spar may be selectively rotated around the longitudinal axis.

In accordance with another important feature of the invention, the sheath has a first side forming a first outer surface and an opposite second side forming a second outer surface. The movable spar has a first convexly curved side and an opposite second convexly curved side.

In accordance with a feature of the invention, the first convexly curved side of the movable spar is connected to the first side of the sheath, and the second convexly curved side of the movable spar connected to the second side of the sheath.

In accordance with an important aspect of the invention, when wind blows against the first outside surface, the movable spar is urged toward the second side of the sheath in a direction substantially perpendicular to the sail plane, thereby transforming the second outside surface into a curved side of an airfoil.

In accordance with an important feature of the invention, when wind blows against the second outside surface, the movable spar is urged toward the first side of the sheath in a direction substantially perpendicular to the sail plane, thereby transforming the first outside surface into a curved side of an airfoil.

In accordance with an aspect of the invention, the movable spar has a substantially egg-shaped cross section.

In accordance with a feature of the invention, the leading spar has a first thickness measured perpendicular to the sail plane. The movable spar has a second thickness measured perpendicular to the sail plane, the second thickness being greater than the first thickness.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 4 is an enlarged cross sectional view of the sail showing how it forms an airfoil shape;

FIG. 5 is another enlarged cross sectional view of the sail showing how it forms an oppositely oriented airfoil shape;

FIG. 6 is a graph of push force vs. wind aspect angle;

MODES FOR CARRYING OUT THE INVENTION

Figure 1:
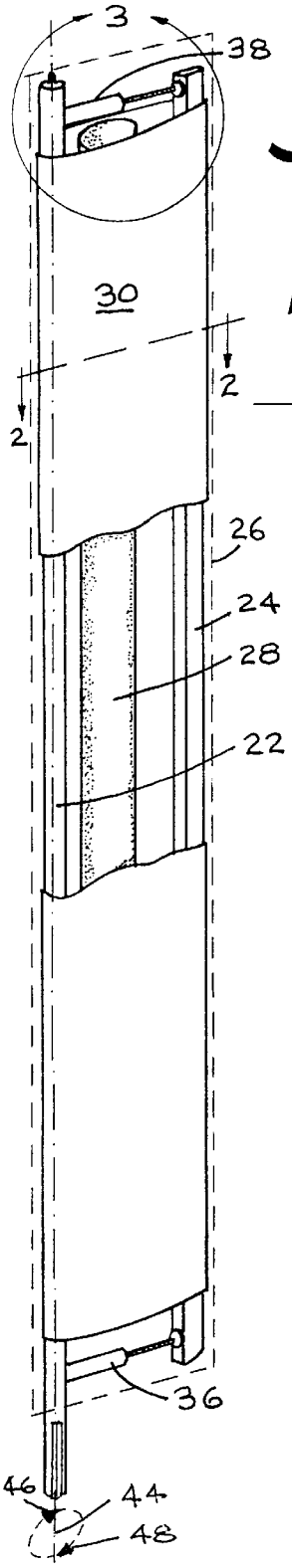
FIG. 1 is a perspective view of a sail in accordance with the present invention.
Figure 2:
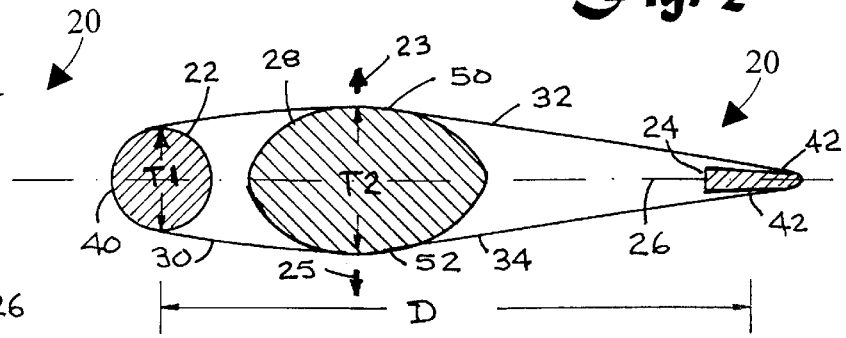
FIG. 2 is an enlarged cross sectional view along the line 2—2 of FIG. 1.
Figure 3:
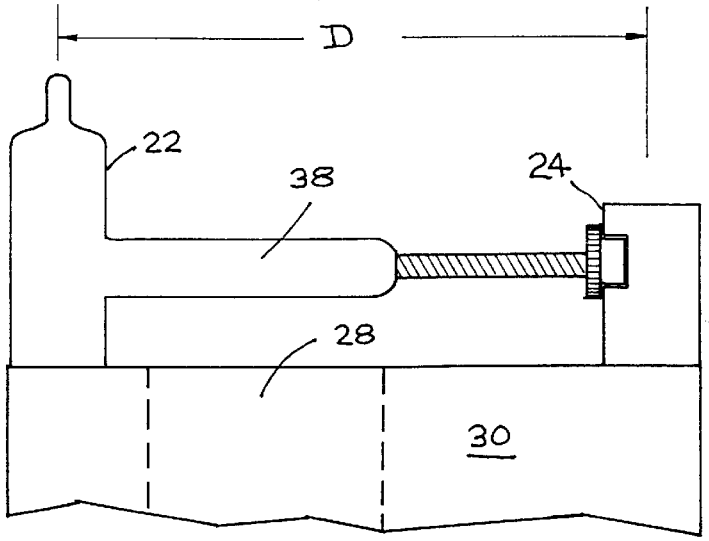
FIG. 3 is an enlarged fragmented side elevation view of the area 3 of FIG. 1.

Referring initially to FIGS. 1 and 2, there are illustrated perspective and enlarged cross sectional views of a sail in accordance with the present invention, generally designated as 20. Sail 20 includes a leading spar 22, and a trailing spar 24. Leading spar 22 and trailing spar 24 are substantially coplanar, and define a sail plane 26. A movable spar 28 is disposed between leading spar 22 and trailing spar 24. Movable spar 28 is substantially parallel to sail plane 26, and is moveable in a direction substantially perpendicular to sail plane 26. Referring to FIG. 2, movable spar 28 is movable in either direction 23 or in direction 25. Leading spar 22, movable spar 28, and trailing spar 24 are traversely surrounded by a sheath of sail cloth 30, thereby forming a double sided, flexible surface sail 20, which is generally shaped like a wing. Sheath 30 has a first side which forms a first outer surface 32, and an opposite second side which forms a second outer surface 34. It is noted that as used herein, the term sail cloth broadly applies to any cloth material, fabric, synthetic, or the like, which is suitable for the fashioning of a sail. In a preferred embodiment, leading spar 22, trailing spar 24, and movable spar 26 are all substantially parallel, with leading spar 22 spaced a predetermined distance D from trailing spar 24. (also refer to FIG. 3) Distance D defines the chord or width of sail 20. Also in a preferred embodiment, at least one traverse rib 36 connects leading spar 22 to trailing spar 24. In the shown embodiment, two traverse ribs 36 and 38 are employed. Traverse ribs 36 and 38 are substantially perpendicular to leading spar 22, and are longitudinally adjustable so that predetermined distance D may be selectively changed. By increasing predetermined distance D, sheath 30 is tightened around leading spar 22, movable spar 28, and trailing spar 24. This adjusts the tension in sheath 30 so that it will form the proper airfoil shape as the movable spar 28 is urged to one side or the other by the wind.

As can be seen in FIG. 1, leading spar 22 has a first length, trailing spar 24 has a second length, movable spar 28 has a third length, and sheath 30 has a fourth length, wherein the first length is greater than the second length, the second length is greater than the third length, and the third length is substantially equal to the fourth length. Referring to FIG. 2, leading spar 22 has a curved or rounded leading edge 40 which abuts sheath 30. When sail 20 is in use, it is leading spar 22 which is turned into the wind, and therefore curved leading edge 40 offers less wind resistance similar to the leading edge of an airplane wing. In a preferred embodiment, leading spar 22 has a substantially circular cross section. Trailing spar 24 on the other hand has a substantially V-shaped edge 42 which abuts sheath 30, with the bottom of the V directed away from the wind. In a preferred embodiment trailing spar 24 has a substantially wedge-shaped cross section.

In order to form an optimum airfoil shape, movable spar 28 should be located nearer to leading spar 22 than it is to trailing spar 24. In a preferred embodiment, movable spar 28 is located approximately one-third to one-quarter of chord D away from leading spar 22. In order to adjust the orientation of sail 20 with respect to the direction of the wind, a rotary means is connected to leading spar 22 so that leading spar 22, and therefore sail 20, may be selectively rotated around the longitudinal axis 44 of leading spar 22 (also refer to FIG. 12). In FIG. 1, leading spar 22 may be selectively rotated around longitudinal axis 44 in either direction 46 or 48. The rotary means can be either mechanically or electrically controlled, and can be connected to leading spar 22 at any convenient location. In a preferred embodiment, the connection of the rotary means is at the bottom of leading spar 22.

Referring to FIG. 2, sheath 30 has a first side which forms a first outer surface 32, and an opposite second side which forms a second outer surface 34. Movable spar 28 has a first convexly curved side 50 and an opposite second convexly curved side 52. First convexly curved side 50 of movable spar 28 is connected to the first side of sheath 30, and second convexly curved surface 52 of spar 28 is connected to the second side of sheath 30. The connection should be made at the top and bottom of movable spar 22, and every one to three meters in between. The connection can be made by any convenient means such as glue, staples, stitching, Velcro™, etc. In a preferred embodiment, movable spar 28 has a substantially egg-shaped cross section, with the thicker side facing leading spar 22. Leading spar 22 has a first thickness T1 measured perpendicular to sail plane 26, and movable spar 28 has a second thickness T2 also measured perpendicular to sail plane 26. In order for outer surfaces 50 and 52 to form an optimum airfoil shape, movable spar 28 thickness T2 should be slightly greater than leading spar 22 thickness T1. For example, if leading spar 22 is 10 cm thick, then moving spar 28 should be 12–15 cm thick.

Referring now to FIG. 4, there is illustrated a cross sectional view of sail 20 showing how it forms into an airfoil shape. When wind 600, which forms an angle of attack A° with sail plane 26, blows against second outer surface 34, movable spar 28 is urged toward the first side of sheath 30 in a direction 54 which is substantially perpendicular to sail plane 26. First curved surface 50 of movable spar 28 therefore pushes against the first side of sheath 30 and transforms first outer surface 32 into the curved or long side of an airfoil. Ideally the windward side of movable spar 28 (side 52 in this case) will only touch the second side of sheath 30 in one place, and second outer surface 34 will form the substantially straight or short side of an airfoil. If second outer surface 34 bows inward, adjustable ribs 36 and 38 can be lengthened to achieve the proper tension in sheath 30, and therefore the proper substantially straight shape of second outer surface 34. It is noted that as first outer surface 32 is bowed outward by movable spar 28, sheath 30 can slip around the edge 40 of leading spar 22 as the curved side of the airfoil is created. Additionally, the sail cloth can also stretch slightly to allow the airfoil shape to develop. Since the curved side 32 of the formed airfoil is longer than the straight side 34, a pressure differential is created due to the Bernoulli principle, and a push force is created in direction 54. This is of course analogous to the lift force created by the wing of an airplane.

Referring now to FIG. 5, there is illustrated another cross sectional view of sail 20 showing the formation of an oppositely oriented airfoil shape. When wind 600, which forms an angle of attack A° with sail plane 26, blows against first outer surface 32, movable spar 28 is urged toward the second side of sheath 30 in a direction 56 which is substantially perpendicular to sail plane 26. Second curved surface 52 of movable spar 28 therefore pushes against the second side of sheath 30 and transforms second outer surface 34 into the curved or long side of an airfoil, and first outer surface 32 into the straight or short side of an airfoil.

FIG. 6 illustrates the push force that is created by sail 20 as a function of angle of attack A°. It is noted that the force is maximum for angles of attack A° between about 10° and 20°. As the angle of attack A° approaches zero degrees, movable spar 28 is not urged to either side of sheath 30, and no airfoil shape or push force result. Similarly, as the angle of attack A° approaches approximately 50°–60° the air flow around sail 20 will become too turbulent to produce a push force.

Figure 7A:
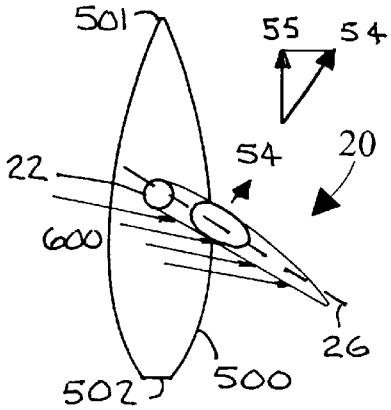
FIGS. 7A, 7B, and 7C are top plan views showing the sail being used on a sailing vessel to sail upwind.
Figure 7B:
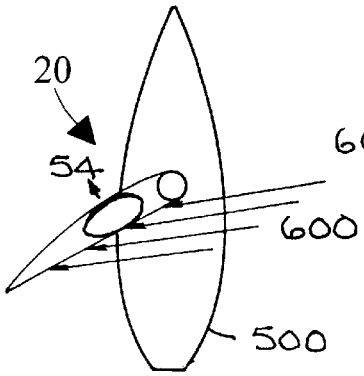
Figure 7C:
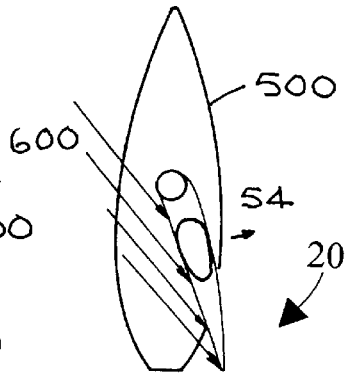

FIGS. 7A, 7B, and 7C are top plan views showing the sail 20 being used on a sailing vessel 500 to sail upwind (into the wind). As a first step, leading spar 22 is allowed to freely rotate so that sail plane 26 aligns with the direction of the wind 600. Then in each case, leading spar 22 of sail 20 has been selectively rotated so that the sail plane 26 forms and angle of attack with the wind A° of between approximately 10° and 20°, thereby resulting in a maximum push force 54. It is noted that while the wind 600 is blowing into the vessel's bow 501, the push force 54 created by sail 20 is nonetheless directed toward the bow 501 so that the vessel 500 may move forward. In FIG. 7A the push force 54 has a longitudinal component 55 which is directed toward the bow 501 along the center line of the vessel 500. It is noted that as used herein, positive angles of attack A° result in push forces 54 which are directed generally toward the bow 501 of the sailing vessel 500, and negative angles of attack A° result in push forces 54 which are directed generally toward the stern 502 of the sailing vessel.

Figure 8A:
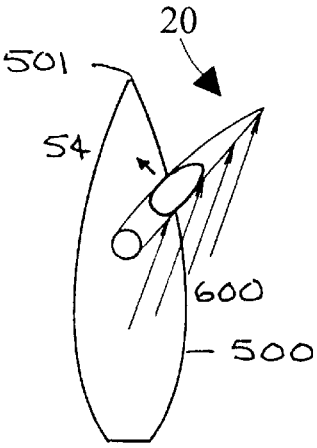
FIGS. 8A, 8B, and 8C are top plan views showing the sail being used on a sailing vessel to sail downwind.
Figure 8B:
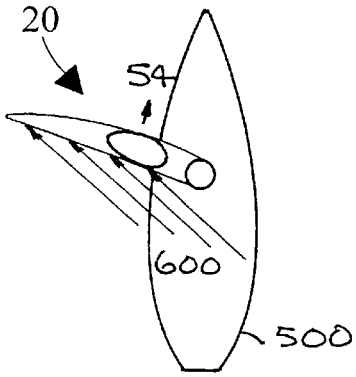
Figure 8C:
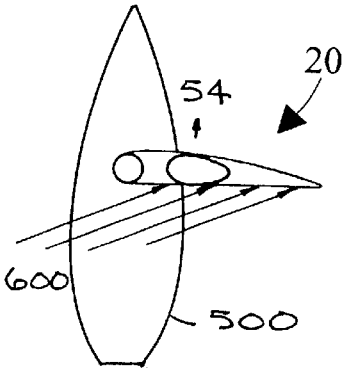

FIGS. 8A, 8B, and 8C are top plan views showing the sail 20 being used on a sailing vessel 500 to sail downwind (with the wind). Again leading spar 22 of sail 20 has been rotated so that sail plan 26 forms an angle of attack A° of between about 10° and 20°. In FIGS. 7 and 8, leading spar 22 is continuously selectively rotated so that the angle of attack A° is maintained between substantially 10° and 20°, and the a push force 54 is created upon sail 20 whose longitudinal component is directed toward the bow 501 of sailing vessel 500.

Figure 9:
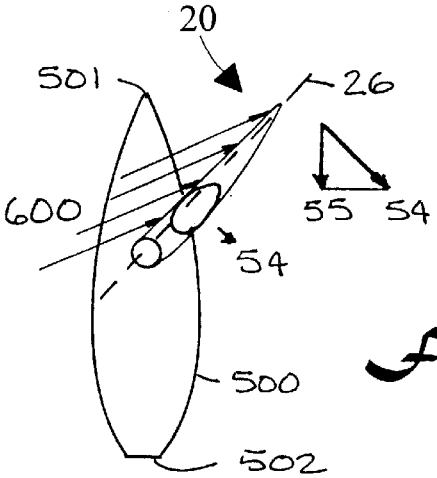
FIG. 9 is a top plan view of the sail being used to brake or slow down a sailing vessel.

FIG. 9 is a top plan view of sail 20 being used to brake or slow down a sailing vessel 500. This a very unique and important property of the subject invention. In FIG. 8A sail 20 was rotated to align with following wind 600 so that a maximum push force 54 was generated in the general direction of the vessel's bow 501. However, what if for some reason it was necessary to rapidly slowdown vessel 500? With the present invention, by simply rotating leading spar 22 and therefore sail plane 26 to an angle of attack A° of between approximately −10° and −20°, the push force 54 can be dramatically changed so that it is generally directed toward the vessel's stern 502, and the vessel 500 consequently quickly slows down. That is, to slow down leading spar 22 is rapidly rotated so that the angle of attack A° is maintained between substantially −10° and −20°, and push force 54 is created upon sail 20 whose longitudinal component 55 is directed toward the stern 502 of sailing vessel 500 along the vessel's centerline.

Figure 10:
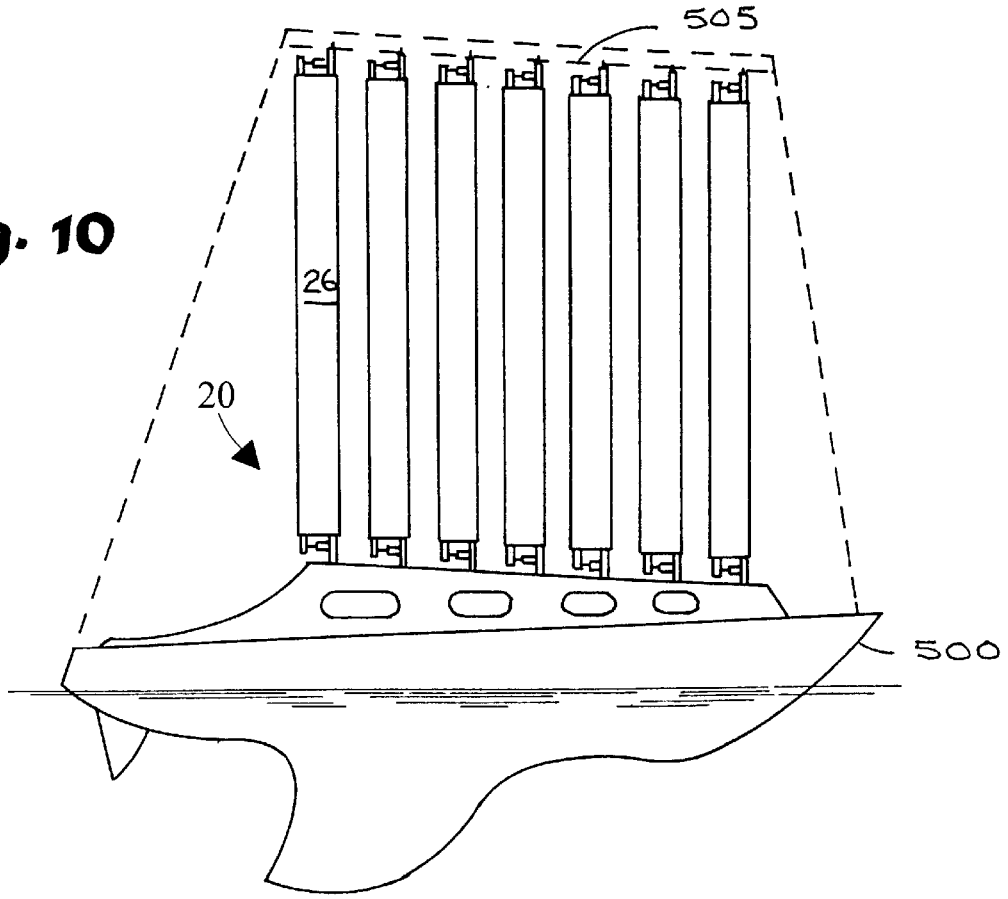
FIG. 10 is a side elevation view of a plurality of sails mounted vertically on a sailing vessel.

FIG. 10 is a side elevation view of a plurality of sails 20 mounted vertically on a sailing vessel 500. Horizontal rods or stays 505 can be utilized to provide additional support for longer sails 20.

Figure 11:
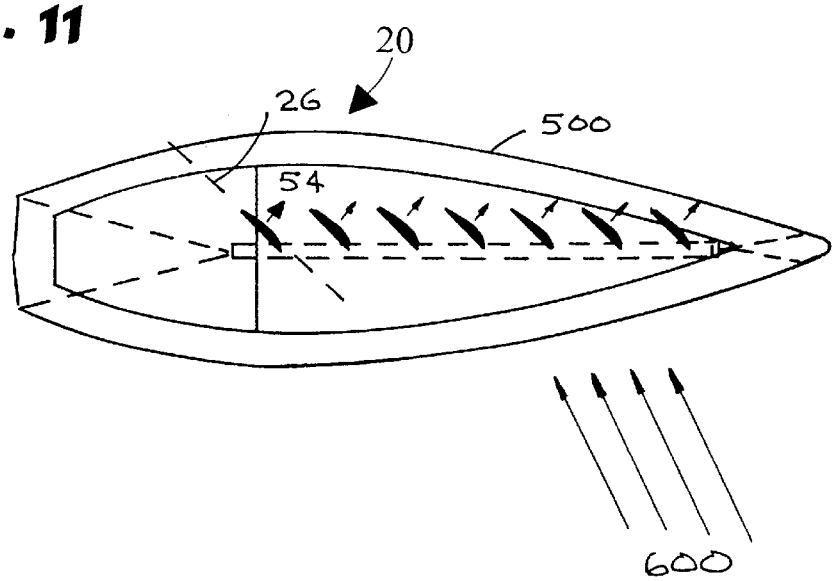
FIG. 11 is a top plan view of a plurality of sails mounted vertically on a sailing vessel.

FIG. 11 is a top plan view of a plurality of sails 20 mounted vertically on a sailing vessel 500. Sails 20 are simultaneously rotated so that all the sails 20 and sail planes 26 are continuously parallel, and all created push forces 54 are parallel.

Figure 12:
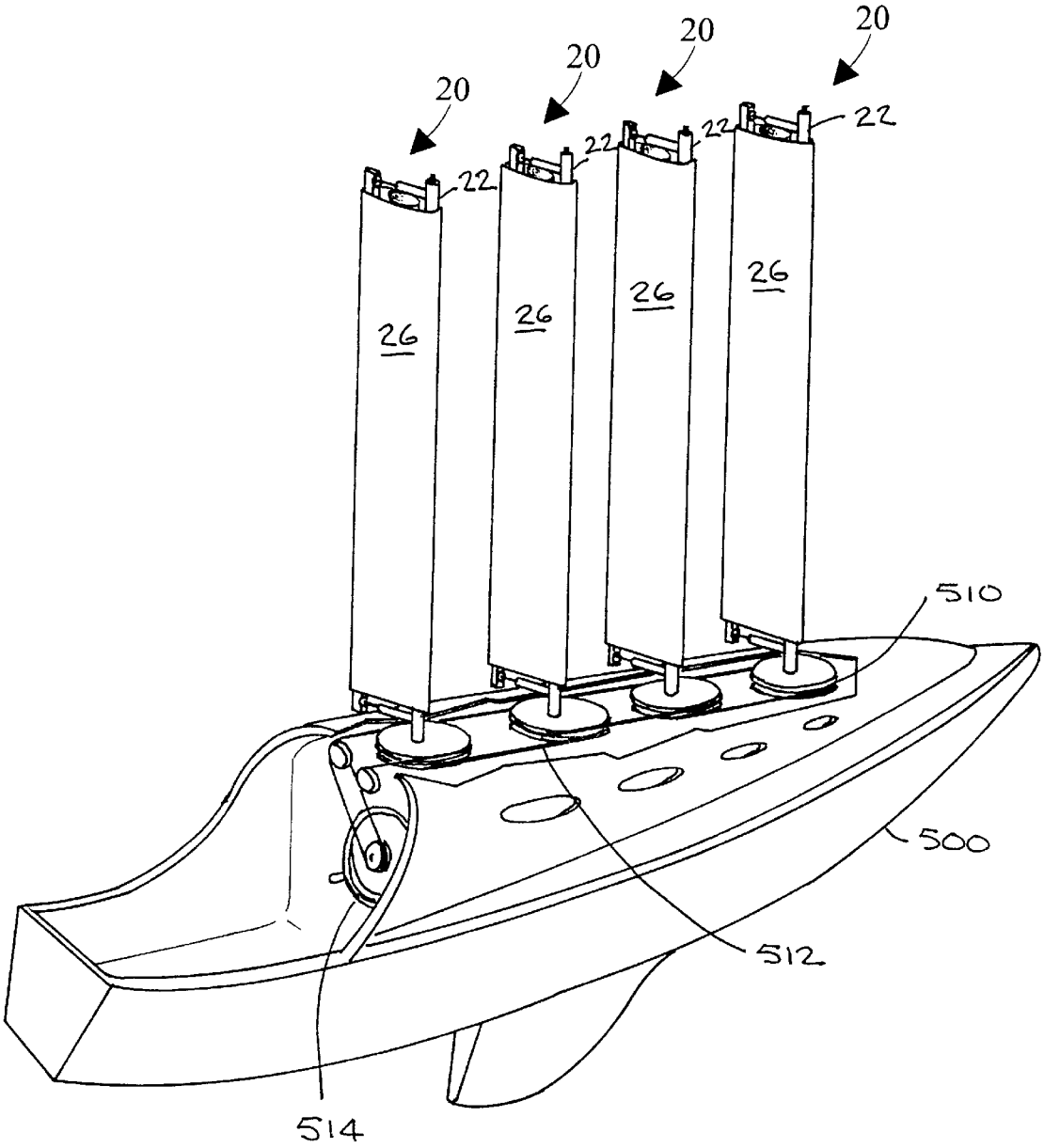
FIG. 12 shows a rotary means for rotating the leading spars and keeping the sail planes of a plurality of sails parallel.

FIG. 12 shows a rotary means for rotating leading spars 22 and keeping the sail planes 26 of a plurality of sails 20 parallel. In the shown embodiment, a plurality of toothed pulleys 510 are attached to the top of the vessel's 500 cabin roof. Each pulley 510 removably receives the leading spar 22 of a sail 20. A chain 512 connects the pulleys 510 to a wheel 514. As wheel 514 is turned, the pulleys 510 all turn in unison thereby keeping all of the sail planes 26 parallel. A clutch mechanism can be incorporated in wheel 514 which allows wheel 514 and thereby pulleys 510 to rotate freely. This will result in all of the sails 20 aligning with the wind. Of course, other mechanical methods could be utilized to turn the sails 20 in parallel unison. Alternatively, a synchronous motor drive system could also be employed.

Leading spar 22 and trailing spar 24 can be fabricated from aluminum, composite materials, or even wooden shafts. Movable spar 28 however, is best fabricated from a light weight material such as polyurethane, hollow plastic tubing, or "bubbled nylon". In an alternative embodiment, trailing spar 24 could be a taught cable rather than a solid spar.

The number, size, and shape of sail 20 are selected to best fit the particular sailing vessel 500. In general, as the size of the sailing vessel 500 increases, the number of sails 20 also increases. For example, for a 9–10 meter sailing vessel 500, there should be approximately six to eight vertically mounted sails 20 of 3–5 meter height, an approximate 0.45–0.65 meter chord (width), and a leading spar 22 thickness of approximately 7–10 centimeters. In practice, the width of the chord is limited because of the amount of torque produced by sail 20. For a 3–5 meter vessel 500 two or three sails of the same or smaller size would suffice. For convenience of storage aboard the sailing vessel 500, the height of sails 20 should not be greater than the length of the vessel's 500 cabin roof. Multiple sails 20 should be set so that there is an approximate 5–10 centimeter clearance between the trailing spar 24 of one sail 20 and the leading spar 22 of the next sail 20. It is also noted that sail 20 has a very high aspect ratio, and is therefore more efficient than conventional sails. The aspect ratio is defined as the height to chord ratio, and for sail 20 is approximately eight to ten.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A sail, comprising:

a leading spar;

a trailing spar connected to said leading spar;

said leading spar and said trailing spar substantially coplanar and defining a sail plane;

a movable spar disposed between said leading spar and said trailing spar, said movable spar substantially parallel to said sail plane;

said leading spar, said movable spar, and said trailing spar traversely surrounded by a sheath of sail cloth; and, said movable spar moveable in a direction substantially perpendicular to said sail plane.

2. A sail according to claim 1, wherein said leading spar, said trailing spar, and said movable spar are substantially parallel, and said leading spar is spaced a predetermined distance from said trailing spar.

3. A sail according to claim 2, further including at least one traverse rib connecting said leading spar and said trailing spar, said traverse rib substantially perpendicular to said leading spar.

4. A sail according to claim 3, wherein said traverse ribs are longitudinally adjustable so that said predetermined distance may be selectively changed.

5. A sail according to claim 2, further including said leading spar having a first length, said trailing spar having a second length, said movable spar having a third length, and said sheath having a fourth length, wherein said first length is greater than said second length, and said second length is greater than said third length, and said third length is substantially equal to said fourth length.

6. A sail according to claim 1, wherein said leading spar has a curved leading edge which abuts said sheath.

7. A sail according to claim 6, wherein said leading spar has a substantially circular cross section.

8. A sail according to claim 1, wherein said trailing spar has a substantially V-shaped trailing edge which abuts said sheath.

9. A sail according to claim 8, wherein said trailing spar has a substantially wedge-shaped cross section.

10. A sail according to claim 1, wherein said movable spar is located nearer to said leading spar than to said trailing spar.

11. A sail according to claim 1, further including:

said leading spar having a longitudinal axis; and, a rotary means connected to said leading spar so that said leading spar may be selectively rotated around said longitudinal axis.

12. A sail according to claim 1, further including:

said sheath having a first side forming a first outer surface and an opposite second side forming a second outer surface; and, said movable spar having a first convexly curved side and an opposite second convexly curved side.

13. A sail according to claim 12, further including:

said first convexly curved side of said movable spar connected to said first side of said sheath; and, said second convexly curved side of said movable spar connected to said second side of said sheath.

14. A sail according to claim 12, wherein when wind blows against said first outside surface, said movable spar is urged toward said second side of said sheath in a direction substantially perpendicular to said sail plane, thereby transforming said second outside surface into a curved side of an airfoil.

15. A sail according to claim 12, wherein when wind blows against said second outside surface, said movable spar is urged toward said first side of said sheath in a direction substantially perpendicular to said sail plane, thereby transforming said first outside surface into a curved side of an airfoil.

16. A sail according to claim 1, wherein said movable spar has a substantially egg-shaped cross section.

17. A sail according to claim 1, further including:

said leading spar having a first thickness measured perpendicular to said sail plane;

said movable spar having a second thickness measured perpendicular to said sail plane; and, said second thickness greater than said first thickness.

18. A sail according to claim 1, further including:

at least one said sail mounted vertically on a sailing vessel.

19. A method of sailing a sailing vessel, comprising the steps of:

providing a sail, comprising a leading spar, a trailing spar connected to said leading spar, said leading spar and said trailing spar coplanar and defining a sail plane, a movable spar disposed between said leading spar and said trailing spar, said movable spar substantially parallel to said sail plane, said movable spar moveable in a direction substantially perpendicular to said sail plane, said leading spar, said movable spar, and said trailing spar traversely surrounded by a sheath of sail cloth, said leading spar having a longitudinal axis, and a rotary means connected to said leading spar so that said leading spar may be selectively rotated around said longitudinal axis;

providing a sailing vessel having a bow and a stern;

mounting at least one said sail vertically on the sailing vessel;

allowing said leading spar to freely rotate so that said sail plane aligns with the direction of the wind;

selectively rotating said leading spar so that said sail plane forms an angle of attack with the wind, said movable spar urged away from the wind, and said sail assuming the shape of an airfoil.

20. The method of claim 19, further including the step of:

continuously selectively rotating said leading spar so that said angle of attack is maintained between substantially 10° and 200°, and a push force is created upon sail whose longitudinal component is directed toward the bow.

21. The method of claim 20, further including the step of:

rapidly rotating said leading spar so that said angle of attack is maintained between substantially −10° and −20°, and a push force is created upon said sail whose longitudinal component is directed toward the stern.

22. The method of claim 19, further including the steps of:

providing a plurality of said sails mounted on the sailing-vessel;

simultaneously rotating each said sail so that all said sail planes are continuously parallel.

23. The method of claim 19, further including the steps of:

providing sail trailing spar substantially parallel to said leading spar;

providing at least one longitudinally adjustable traverse-rib connecting said leading spar and said trailing spar; and, adjusting said traverse rib so that said predetermined distance is increased and said sheath is tightened around said leading spar, said movable spar, and said trailing spar.

* * * * *

UNITED STATES PATENT AND TRADEMARK OFFICE

CERTIFICATE OF CORRECTION

PATENT NO. : 5,868,092

DATED : Feb. 9, 1999

INVENTOR(S) : Milidragovic

It is certified that error appears in the above-identified patent and that said Letters Patent is hereby corrected as shown below:

In claim 20, column 9, line 12, delete "200°" and insert -- 20° -- therefor.

In claim 23, column 10, line 7, delete "sail" and insert -- said -- therefor.

Signed and Sealed this

Twenty-ninth Day of June, 1999

*Attest:*

*Attesting Officer*

Q. TODD DICKINSON

*Acting Commissioner of Patents and Trademarks*